United States Patent [19]

Meyers et al.

[11] Patent Number: 5,065,827

[45] Date of Patent: Nov. 19, 1991

[54] HAMMER BIT RETENTION TOOL

[75] Inventors: John A. Meyers, New Iberia, La.; David E. Drake, Roscoe, Tex.; Charles W. Witt, Fort Smith, Ark.

[73] Assignee: Smith International, Inc., Houston, Tex.

[21] Appl. No.: 632,266

[22] Filed: Dec. 21, 1990

[51] Int. Cl.[5] ..... E21B 10/36

[52] U.S. Cl. ..... 175/414; 175/293

[58] Field of Search ..... 175/414–419, 175/293–295, 298, 300, 301, 302

[56] References Cited

U.S. PATENT DOCUMENTS 3,322,216 5/1967 Kurt ..... 175/293

3,353,613 11/1967 Harrison ..... 175/293

4,241,800 12/1980 Stenuick ..... 175/417 X 4,727,944 3/1988 Bottoms ..... 175/293

*Primary Examiner*—Thuy M. Bui

*Attorney, Agent, or Firm*—Robert M. Vargo

[57] ABSTRACT

A retention system is disclosed for a hammer-percussion bit assembly which prevents the loss of the lower section of bit after a crack propagates through the shank (rotational drive) section of the bit. The system includes retainer which is mounted onto the drive sub of the assembly. The retainer is adapted to extend around the head section of the bit and functions to grab the severed bit head section upon lifting of the drill string while not interfering with the normal operation of the assembly.

11 Claims, 2 Drawing Sheets

HAMMER BIT RETENTION TOOL

BACKGROUND OF THE INVENTION

I. Field of the Invention

This invention relates generally to earth boring percussion bits, and more specifically to retention systems for ensuring that the bit remains coupled to the hammer at all times during the earth boring operation.

II. Description of the Prior Art

FIG. 1 of the drawings illustrates a standard hammer and percussion bit assembly, generally indicated by arrow 10. The assembly comprises a hammer housing 11 threadedly connected at its upper end to a pin connection 12. The pin is utilized for connection to the lower end of the drill string (not shown). The lower end of the housing 11 is threadedly connected to a driver sub 13, which includes a plurality of splines located on the interior thereof for matingly receiving the splines 14 located on the shank 15 of the percussion bit 16 and rotatively driving the same.

A pair of lock rings 17 are fitted to be located within the interior of the housing 11 with the upper end thereof abutting against an annular shoulder ring 18 fixedly mounted within the housing 11. The other end of the lock rings 17 are adapted to abut the upper end of the driver sub 13 to be held in place therewith. The upper end of the percussion bit 16 includes a piston strike 19 and a foot valve 20. The lower end of the bit 16 includes a head section 21 having a plurality of inserts 22 mounted thereon. A fishing thread 23 is also formed on the upper periphery of the head section 21.

The purpose of the fishing thread 23 is to enable the head section 21 to be successfully fished or threadedly grabbed by a fishing tool should the head section 21 fracture or break away from the bit shank 15 during operation.

Finally, the percussion bit 16 includes an upper bearing section 24 which is adapted to bear against the lock ring 17, and a lower bearing section 25, which is adapted to bear against the interior of the driver sub 13.

The hammer assembly further includes a control rod 26 which, with the interior of the housing 11, forms an annular piston chamber 27. A hollow cylindrical piston 28 is positioned within the chamber 27 to be reciprocated therein. The piston 28 includes a plurality of channels 29 which cooperate with windows 30 of the control rod 26 to enable pressurized air to drive the piston upwardly and downwardly in a conventional manner. The interior of the control rod 26 is adapted to communicate with the interior of the pin connection 12 and the drill string via a back flow valve assembly 31.

The lower end of the piston 28 is adapted to impact against the strike face 19 which imparts a percussive force to the bit 16.

As noted above, the standard bit 16 is retained within a conventional hammer assembly by the ring locks 17, located near the top of the bit shank 15.

Frequently however, in approximately five percent of all bits, the bit will fail due to cyclic fatigue by fracturing below the retaining rings and above the bit head. When this occurs during the drilling operation, the lower section of the bit is left at the bottom of the hole, thereby necessitating a costly and cumbersome fishing operation.

SUMMARY OF THE INVENTION

The present invention obviates the shortcoming described above and decreases the number of broken bits left in the hole by providing means for retaining the bottom section of the bit to the assembly at all times, even when the section is fractured and broken away from the shank of the bit.

The present invention comprises a hammer-percussion bit assembly having a cylindrical retaining member mounted on the exterior of the driver sub. The retaining member extends downwardly therefrom to extend over the upper portion of the bit head section. The lower end of the retaining member includes an inner projection which is adapted to be threaded through the fishing thread of the bit and extend around a reduced section of the bit.

The reduced section of the bit extends a predetermined distance sufficient to enable the bit to move and reciprocate during operation without interference from the retaining member.

Should the bit bottom section break away from the bit shank, the retaining member will grab on to the fishing thread portion of the bit head section to retain the bit section until the entire drill string is lifted out of the hole.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
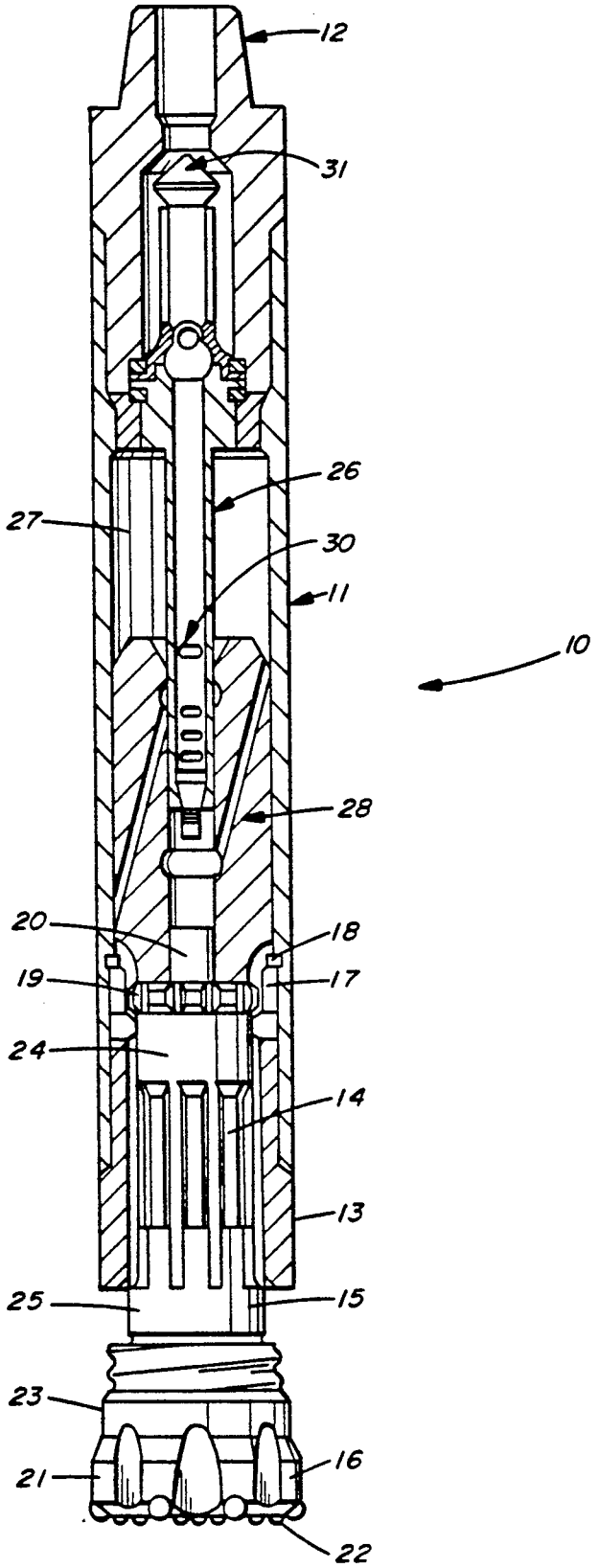
PRIOR ART FIG. 1
FIG. 1 is an elevational view, partly in section, of a conventional hammer-percussion bit assembly.

FIG. 1 has already been utilized to describe a conventional hammer-percussion bit assembly.

Figure 2:
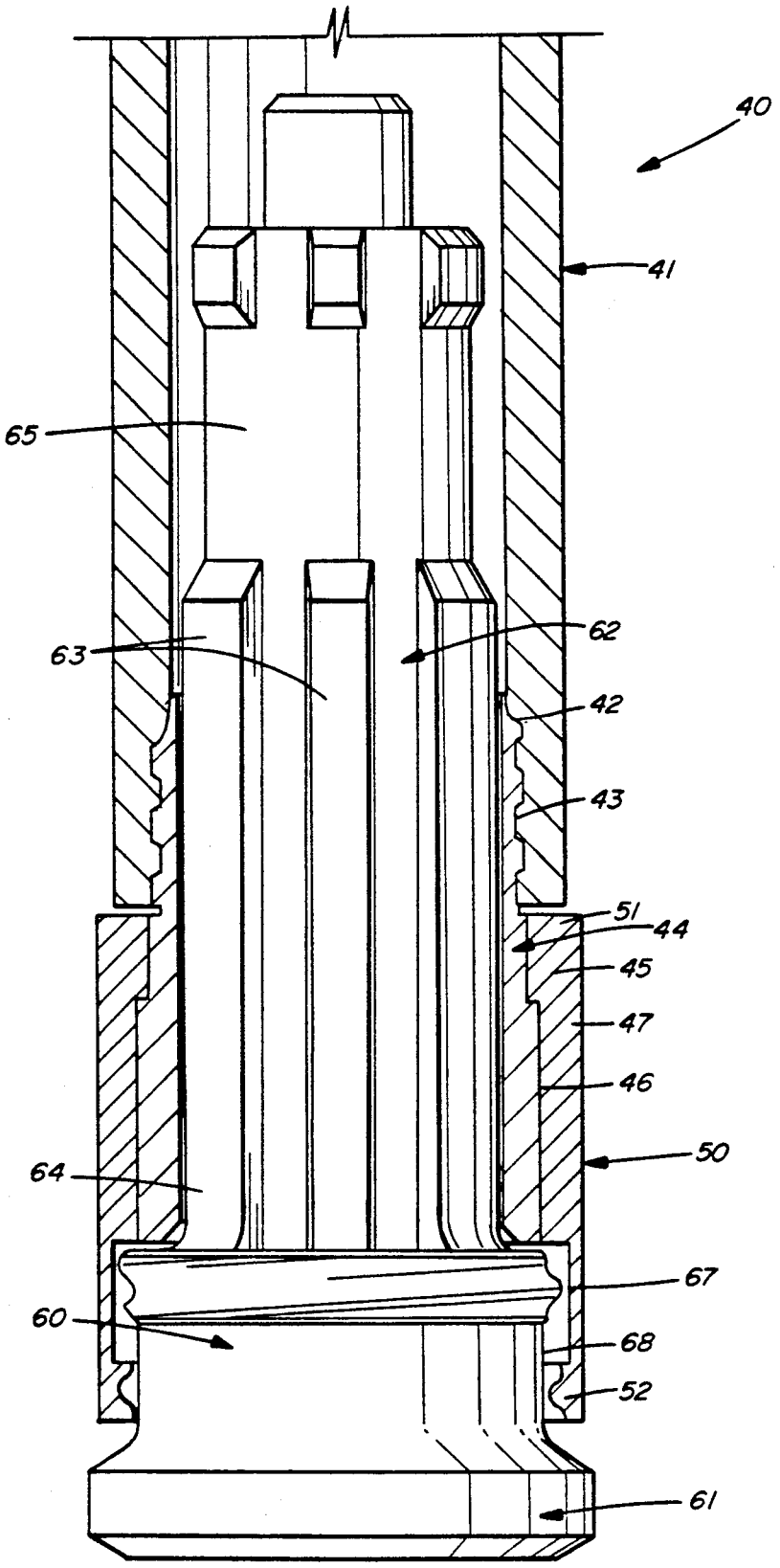
FIG. 2 is an elevational view, partly in section, of the lower end of a hammer and the percussion bit, along with the retention system, all made in accordance with the present invention.

Referring now to FIG. 2, the lower end of a hammer, generally indicated by arrow 40, is shown comprising a housing member 41. The upper end of the hammer 40 is conventional in construction, and is similar to that shown in FIG. 1.

The lower end of the housing member 41 includes an internal thread 42 which is adapted to engage an external thread 43 located on the upper end of a driver sub 44. The interior of the driver sub 44 is splined (not shown) to matingly receive the splined portion of the percussion bit.

The driver sub 44 is cylindrical in construction and includes an outer surface below the threads 43 which is stepped to form a relatively smaller cylindrical section 45 and a relatively larger cylindrical section 46. A ledge 47 is formed on the driver sub 44 interconnecting the two sections.

A retaining member 50 is provided to be mounted on the hammer assembly 40 to extend therebelow. The retaining member 50 is generally cylindrical in construction and includes an upper enlarged portion 51 which extends inwardly to abut within a pocket formed by section 45 and ledge 47 of the driver sub 44. The upper end of the enlarged portion 51 forms a shoulder which is adapted to be co-extensive with the upper shoulder formed on the cylindrical portion 45. Both of these shoulders are adapted to abut the lower shoulder formed on the housing member 41 when the driver sub 44 is fully threaded onto the housing member 41. The lower end of the retaining member 50 includes an inwardly extending projection 52 which is shaped in the form of an external thread, the utility of which will be explained hereinafter.

The percussion bit 60 is substantially similar to the bit shown in FIG. 1 except for a few modifications which will be explained hereinafter. The bit 60 includes a bit head section 61 and a shank section 62. The shank section 62 includes a plurality of splines 63 which interact with the splines of the driver sub 44. The shank section 62 further includes a first bearing section 64 which is adapted to bear against the driver sub 44, and a second bearing section 65 which is adapted to engage the lock rings (not shown) in the conventional manner. Finally, the shank section 62 includes a strike section 66 which is adapted to receive the impacts of the hammer piston (not shown), again in the conventional manner shown in FIG. 1.

The percussion bit head section 61 includes a lower portion which has a plurality of inserts (not shown) mounted thereon. The upper portion of the head section 61 includes a fishing thread 67 formed thereon. The fishing thread 67 does not extend as far down the head section 61 as a conventional bit shown in FIG. 1. Instead the thread 67 terminates earlier and a recess 68 is formed on the head section 61 directly below the thread 67.

In assembling the bit 60 onto the hammer 40, the driver sub 44 and retaining member 50 are separated as a unit from the hammer casing 41. The shank portion 62 of the bit 60 is then inserted upwardly through the two components until the head section 61 abuts with the lower end of the retaining member 50. At that point, the projection 52 of the retaining member 50 are brought into threaded engagement with the fishing thread 67 and the retaining member 50 is rotated relative to the driver sub 44 and the bit 60 until the projection 52 passes completely through the thread 67 and extends into the recess 68. The three components are then inserted into the hammer casing 41 and the driver sub 44 is threadedly connected thereto.

In operation, the hammer bit assembly is allowed to function in the conventional manner without interference from the retention means. This is because the projection 52 is free to move within the recess 68 of the bit 60 while the bit is moving.

Should the head section 61 break away from the shank 62 and any point on the shank, upon lifting the drill string, the projection 52 will grab onto the fishing thread portion of the bit 60 to retain the bit and prevent it from falling into the borehole.

It should be noted for added security, a pin could be inserted through the wall of the retaining member 50 to extend into the recess 68. The freedom of bit movement during operation would still be maintained, however the projection 52 would be prevented from threading itself through the fishing thread 67 during the movement up the borehole.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A hammer-percussion bit assembly connected to the lower end of a drill string for earth boring operations comprising:

a hammer assembly for imparting kinetic energy to a percussion bit;

a percussion bit having a shank portion mounted within said hammer assembly and a head section extending out of the lower end of said hammer assembly; and means for retaining the head section of said bit to the assembly during operation and thereafter, should the head section fracture and separate from the shank section.

2. The invention of claim 1 wherein said retaining means further includes means for allowing normal operation of the hammer-bit assembly without interference while still maintaining the retaining capabilities.

3. The invention of claim 1 wherein said hammer assembly includes a drive sub mounted on the lower end of the hammer assembly, said drive sub being interlockingly engaged to the shank section of said bit.

4. The invention of claim 3 wherein said retaining means comprises a retention member attached to said drive sub.

5. The invention of claim 4 wherein said retention member is rotatively mounted on said drive sub.

6. The invention of claim 5 wherein said retention member extends around said bit and further comprises means for attaching to said bit.

7. The invention of claim 6 wherein said attaching means comprises an inwardly extending projection.

8. The invention of claim 7 wherein the head section of said bit comprises a threaded portion, and an annular recess below the threaded portion, said attaching means projection adapted to pass through the threaded portion of said bit during assembly and extend into said recess during operation of said hammer-bit assembly.

9. The invention of claim 8 wherein said attaching means further comprises a pin adapted to extend through the wall of said retention member and into the recess of said bit.

10. The invention of claim 7 wherein said retention member comprises a hollow cylindrical body extending around said bit, and said attaching means comprises an annular inwardly extending thread portion.

11. The invention of claim 10 wherein the head section of said bit comprises a threaded portion and an annular recess below the threaded portion, the annular thread portion of said retention member adapted to pass through the threaded portion of said bit during assembly and extend into said recess during operation of said hammer-bit assembly.

* * * * *